United States Patent [19]

DePillo

[11] 4,415,212

[45] Nov. 15, 1983

[54] CONNECTOR RECEPTACLE FOR PRINTED CIRCUIT BOARDS

[75] Inventor: Lawrence V. DePillo, Waterbury, Conn.

[73] Assignee: Mark Eyelet & Stamping, Inc., Wolcott, Conn.

[21] Appl. No.: 304,369

[22] Filed: Sep. 21, 1981

[51] Int. Cl.[3] ..... H01R 9/09; H01R 13/11

[52] U.S. Cl. ..... 339/17 C; 339/221 R

[58] Field of Search ..... 339/17 C, 221 R, 221 L, 339/221 M, 258 R

[56] References Cited

U.S. PATENT DOCUMENTS

| | | | |
|---|---|---|---|
| 3,899,232 | 8/1975 | Berg | 339/17 C |
| 3,922,057 | 11/1975 | Lemke et al. | 339/17 C X |
| 4,257,667 | 3/1981 | Iantorno | 339/221 R |
| 4,266,838 | 5/1981 | Segrott | 339/17 C |

*Primary Examiner*—Mark Rosenbaum

*Attorney, Agent, or Firm*—H. Gibner Lehmann; K. Gibner Lehmann

[57] ABSTRACT

A connector receptacle for insertion in openings of a printed circuit board to receive other contact components, such as the contact pin of a cooperable connector. The connector receptacle has a tubular body portion which fits into the circuit board opening, and has an external shoulder that functions as a stop during the inserting movement. The body portion contains a spring contactor for engagement with the other component, as the contact pin of the cooperable connector. For retaining the connector receptacle firmly positioned in the circuit board, it has at least one external resilient spring retainer finger, and preferably two fingers which extend lengthwise of the tubular body and engage the circuit board at the opening thereof. The retainer fingers are movable independently of the body, and are formed integrally with the body. The connector receptacle is constituted as a metal stamping, which can be precisely formed to very close tolerances while at the same time being economical to produce.

10 Claims, 7 Drawing Figures

CONNECTOR RECEPTACLE FOR PRINTED CIRCUIT BOARDS

BACKGROUND

This invention relates to small connector receptacles in the form of miniature metal shells which are intended for insertion in openings of printed circuit boards, and more particularly to such receptacles wherein there are friction contact means adapted to co-act with contact pins of cooperable male connectors.

Heretofore various types of connector receptacles of the above kind have been proposed and produced. Commonly these have generally comprised tubular metal shells or cups in which spring contactors are disposed for engagement with the contact pins of cooperable connectors. The tubular shells or cups are inserted in openings of printed circuit boards with a sliding fit, and their walls are variously formed or embossed to effect a retention of the cup in the board after its insertion. Some cups are knurled for this purpose, others are formed with a non-circular cross section, and various diverse configurations have been employed in the past during the fabrication of the shell or cup, by modification of its wall to effect the retention.

In one prior construction the inner spring contactor was provided with resilient fingers which folded down alongside the outer shell or cup for the purpose of yieldably engaging the walls of the opening in the circuit board, to effect the retention. However, this construction had a drawback inasmuch as during the wave soldering of the connector, it sometimes happened that the solder would travel along the spring fingers and into the inner spring contactor. This would impair the resilience of the contactor and sometimes rendering it inoperative as a consequence.

Mainly the objective in the past has been to maintain the cost of the receptacles at a very low, acceptable figure inasmuch as large numbers of these components are utilized in various types of assemblies, where they constitute only a very small percentage of the overall unit.

Many prior receptacle shells or cups have not been fully satisfactory for the reason that they required strictly held tolerances of the opening or hole diameters in the circuit boards, and it was difficult or else undesirable to maintain such precise measurements of the openings. In consequence, it was found that the shells or cups would be only loosely held and not sufficiently secure, or else that they had too tight a fit, in which case it interfered with the easy insertion and also the subsequent operation. Some shells would become distorted where the openings in the circuit board were too small, and this altered the proper functioning of the spring contactor which was disposed in the shell.

In general, the prior working or forming of the shell wall to effect a retention was found to be unacceptable, also for the reason that it tended to restrict its use in some cases. At the same time, the forming of the shell walls in special shapes had to be critically considered because it was necessary to avoid an increase in the cost of the receptacle shells, since this would undesirably affect the cost of the assemblies where the shells were utilized.

SUMMARY

The above disadvantages and drawbacks of prior connector receptacles for printed circuit boards are obviated by the present invention, which has for one object the provision of a novel and improved metal connector receptacle which can be very economically produced and which at the same time will be uniformly, securely retained in production circuit boards despite the commercially-dictated variations in the openings provided in such boards.

Another object of the invention is to provide an improved connector receptacle of the kind under consideration, wherein there is eliminated the likelihood of solder creeping into the inside spring contactor and causing malfunctioning of the same.

Still another object of the invention is to provide an improved connector receptacle as above characterized, which can be readily fabricated as a sheet metal stamping and still held to very precise tolerances, by which the receptacle can be utilized with circuit boards having considerable variations in the openings thereof.

A further object of the invention is to provide an improved connector receptacle in the form of a sheet metal stamping as above set forth, wherein one or several external resilient spring retainer fingers are provided on the shell or cup body and extend lengthwise thereof so as to co-act with adjoining surfaces of the circuit board to effectively retain the receptacle in place after its initial insertion, without the likelihood of solder getting into and affecting the inner spring contactor.

A feature of the invention resides in the provison of an improved connector receptacle in accordance with the foregoing, wherein the inserting movement can be easily and quickly carried out, either manually or by suitably automatic or semi-automatic equipment, thereby reducing the overall assembly time of the equipment where it is used.

Another feature of the invention resides in the provision of an improved connector receptacle of the kind described above, wherein the integral spring fingers are movable individually and independently of the receptacle shell or cup and yet can receive a backing-up force which constitutes a re-inforcement of the retaining action of the fingers.

The above objects are accomplished by the provision of a unique receptacle or cup component comprising essentially a tubular body which easily, slidably fits into the circuit board opening and which has an external shoulder at its open, mouth portion, thereby to constitute a stop for engagement with the circuit board. A spring contactor shell is disposed in the tubular body, being adapted for engagement with the contact pin of a cooperable connector. The tubular cup body has at least one, and preferably two external resilient spring retainer fingers which extend lengthwise thereof, for engagement with the circuit board to maintain the body in the opening thereof against unintentional dislodgement therefrom, said retainer fingers being movable individually of the body and being integrally formed with the body during a stamping operation. The retainer fingers are joined to the body at the mouth portion thereof and are in the form of a flattened N-configuration. Also, the free ends of the retainer fingers have angular off-sets which are disposed closely adjacent an annular external shoulder of the body whereby they can engage the body to effect a reinforcement or back-up action. The disposition of the spring fingers and their configuration are such as to minimize the likelihood of solder, during the wave soldering operation, creeping into the shell to contaminate the inner spring contactor.

Integral tabs on the cup body are folded inward to effect a positive retention of the spring contactor shell in the body, such tabs being also integrally formed with the body.

Other features and advantages will hereinafter appear.

In the accompanying drawings, illustrating one embodiment of the invention:

Figure 1:
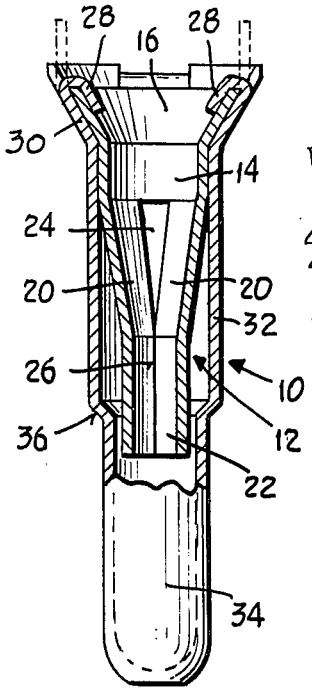
FIG. 1 is a side elevational view of a complete connector receptacle as provided by the invention, with portions broken away and shown in vertical section to reveal interior details. The sectioning of FIG. 1 is taken on the line 1—1 of FIG. 2.
Figure 3:
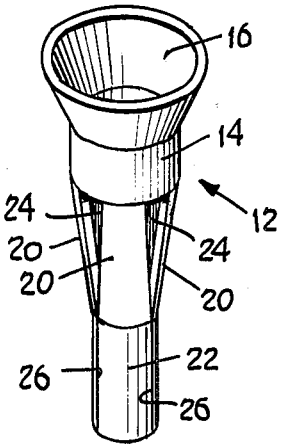
FIG. 3 is a perspective view of the spring contactor shell contained in the receptacle or cup body of the connector.

Referring first to FIG. 1, the connector receptacle of the invention comprises essentially a two-piece assembly, an outer tubular shell or cup 10 also called herein a body portion, which is adapted to loosely slidably fit into an opening of a printed circuit board, and an inner spring contactor component 12 (illustrated also in FIG. 3) which is formed separately from the body portion 10 and assembled to it at a later time.

The spring contactor shell 12 comprises a tubular portion 14 having a flared mouth 16, and a plurality of resilient contact fingers 20 that converge from the portion 14 to a yet smaller, tubular formation 22. At the convergence of the contact fingers 20, triangular slits 24 are disposed, such slits showing as straight line cuts 26 at the tubular formation 22. The contact fingers 20 are thus separated from each other and individually movable, being biased toward the center or axis of the shell to maintain the tubular portion 22 mostly in a closed condition. The contactor shell 12 can fit snugly within the body portion 10 of the receptacle shell or cup at its upper part, and is retained therein by a pair of lugs or tabs 28 integral with a flared mouth 30 of the body portion 10, as clearly seen in FIG. 1.

It will be understood that the contactor shell 12 is so mounted that the spring fingers 20 thereof can shift laterally or radially outward an extent to accommodate the larger diameter of a cooperable contact or component pin which is inserted in the receptacle through the mouth portion 30.

Figure 4:
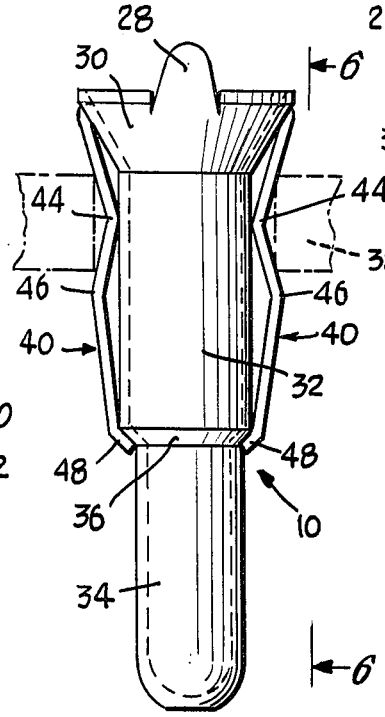
FIG. 4 is a side elevational view of the drawn sheet-metal connector body portion of the receptacle. The location of the printed circuit board with respect to the body portion is illustrated by the broken lines.
Figure 6:
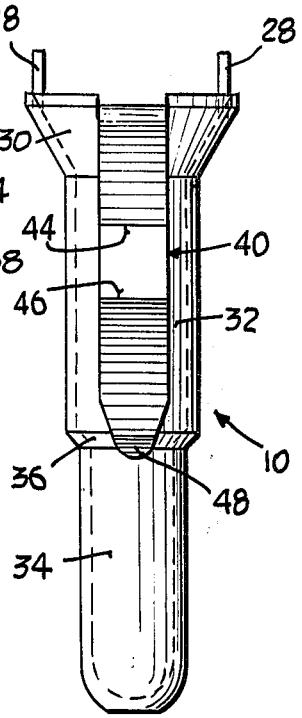
FIG. 6 is a side elevational view of the connector body portion, as viewed in a plane taken at 90 degrees with respect to the viewing plane of FIG. 4.
Figure 2:
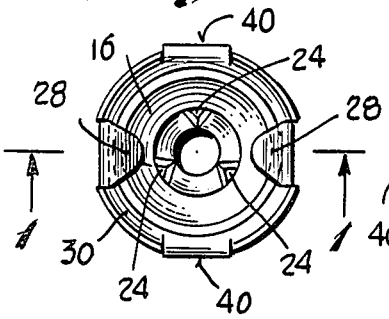
FIG. 2 is a top plan view of the receptacle of FIG. 1.
Figure 5:
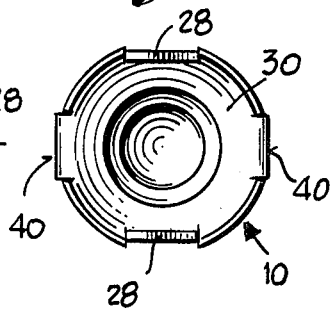
FIG. 5 is a top plan view of the body portion of FIG. 4.

The receptacle body portion 10 is in the form of a deep drawn metal shell having in addition to the flared mouth 30, a main body portion 32 which is joined to the small diameter of the flare 30, and a lower extremity leading or lead-in portion 34 of still smaller diameter at the end opposite of flare 30, which joins the main body portion 32 and forms an exterior annular shoulder 36 at the joint. The end of the shell adjacent the portion 34 is completely closed, as shown in FIGS. 1 and 5. During the forming of the shell or cup body 10, the retainer tabs 28 are also blanked out, as will be understood. The exterior diameter of the main body portion 32 of the receptacle 10 is chosen to have an easy sliding fit in openings provided in a printed circuit board 38, such as that shown in broken outline in FIG. 4, and the leading portions 34 will loosely fit in the circuit board openings, as can be understood.

Figure 7:
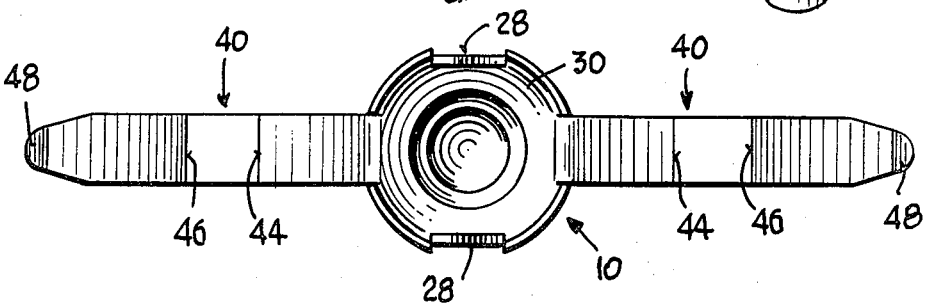
FIG. 7 is a top plan view of the connector body portion during an intermediate stage in its fabrication, wherein the resilient spring retainer fingers have not yet been folded downward, flat against the body portion.

In accordance with the present invention the receptacle body portion 10 is provided with integral external resilient spring retainer fingers 40, two such fingers being illustrated in the drawings and being disposed on opposite sides of the main body portion 32 and extending externally and lengthwise thereof toward the extremity of the leading end portion 34. The spring fingers 40 can be blanked or formed at the same time that the tabs 28 are blanked out, and such forming of the spring fingers 40 preferably occurs after the deep drawing of the body portions 32, 34 has been effected. FIG. 7 illustrates the blanking or formation of the spring fingers 40 initially. As can be readily understood, the retainer fingers 40 are movable independently of the body portion 32 of the shell.

After such blanking of the fingers 40, or during the blanking thereof, the fingers are given a non-linear or flattened N-configuration, with a pair of reverse bends 44, 46. Also, the free end portions of the spring fingers 40 have angular off-sets 48 which result in their being bowed, and which are adapted to extend closely adjacent the external annular shoulder 36 of the shell after the spring fingers have been folded downward to their ultimate positions as shown in FIG. 4, being reinforced thereby. That is, when the offsets 48 of the spring fingers are engaged with the external shoulder 36, a stiffening action of the fingers occurs by which the retention of the shell is made more secure. The flattened N-configuration of the fingers also provides external depressions which tend to accommodate the edges of the opening into which the receptacle is inserted, thereby providing a desirable detent action. The free ends 48 of the fingers 40 terminate short of the extremity of the leading end portion 34, and such free ends enter the openings in the circuit board ahead of the rest of the fingers.

By the above construction the likelihood of solder from the wave soldering operation climbing up the fingers 40 and getting inside the shell 10 into the spring contactor 12 is greatly minimized, as contrasted with prior constructions where the resilient fingers that retain the connector receptacle were provided on the spring contactor 12 itself. In this prior construction the solder could travel along the spring fingers directly to the spring contactor, where it would flow inside and interfere with the proper functioning of the same.

I have found that with the present construction there is provided a very advantageous, precise and yet economical-to-fabricate connector receptacle adapted for inserting in the openings of a printed circuit board. The flare 30 constitutes an external shoulder which provides a stop for engagement with the circuit board during the insertion of the receptacle, and the resilient spring fingers 40 engage the circuit board and securely retain the receptacle in the desired operative position without danger of solder being brought into the receptacle to interfere with the necessary spring contact action. There is no longer required the closely-held tolerances in the openings of the circuit board, and also there is eliminated any malfunctioning during insertion of the receptacle as well as interference with the proper operation of the inner spring contactor shell 12.

The receptacle can be manufactured to very close tolerances in an economical manner whereby it will meet the most exacting requirements and specifications, while at the same time it represents an extremely economical construction.

Variations and modifications are possible without departing from the spirit of the claims.

I claim:

1. A connector receptacle for insertion in an opening of a printed circuit board to receive a contact pin of a cooperable connector, comprising in combination:

(a) a tubular shell adapted to fit into said opening, said shell having at one end a leading portion of reduced diameter adapted to loosely fit into and enter the opening in a circuit board, and having at its opposite end an open mouth portion and external shoulder means at said mouth portion, constituting a stop which is engageable with the circuit board after the shell has been inserted therein, (b) a spring contactor constituting a piece separate from the shell, said contactor being disposed in said shell and adpated for engagement with said contact pin of the cooperable connector, and (c) an external resilient bowed spring retainer finger on the shell, extending lengthwise thereof along its exterior and toward the leading end portion thereof, for engagement with the circuit board to maintain the shell in the opening thereof against inadvertent dislodgement therefrom, (d) said retainer finger having a free end which terminates short of the extremity of said leading end portion of the shell and is adapted to enter the opening in the circuit board ahead of the rest of the finger, and being integral with the shell and movable independently of the shell, and further being integrally connected to the open mouth portion of the shell, (e) said free end being disposed at a location beyond the board when the receptacle is fully seated.

2. A connector receptacle as set forth in claim 1, wherein:

(a) there is an additional resilient finger disposed at the opposite side of the shell, having an extremity which terminates at a location intermediate the ends of the shell.

3. A connector receptacle as set forth in claim 2, wherein:

(a) said additional resilient finger is integral with the shell.

4. A connector receptacle as set forth in claim 2, wherein:

(a) said resilient fingers have a flattened N-configuration.

5. A connector receptacle as set forth in claim 1, wherein:

(a) said resilient finger has a flattened N-configuration.

6. A connector receptacle as set forth in claim 1, wherein:

(a) said shell has an external annular shoulder intermediate its ends, (b) said free end being provided with an angular offset disposed closely adjacent said annular shoulder.

7. A connector receptacle as set forth in claim 1, wherein:

(a) said resilient finger at a point intermediate its ends is adapted to engage the exterior of the shell.

8. A connector receptacle for insertion in an opening of a printed circuit board to receive the contact pin of a cooperable electrical component, comprising in combination:

(a) a one-piece tubular shell adapted to fit into said opening, said shell being completely closed at one end and having an open mouth portion at its other end in which the said contact pin can be inserted, all parts of said shell being integral with one another, (b) a separate and distinct spring contactor disposed in said shell, said contactor being held captive therein and adapted for engagement with said contact pin, and (c) an external resilient spring retainer finger integral with and connected to the shell at its mouth portion, said finger extending lengthwise thereof toward the closed end of the shell for a fractional portion of the length of the body of the shell and being adapted for engagement with the circuit board to maintain the shell in the opening thereof against inadvertent dislodgement therefrom, prior to soldering of the connector receptacle into the opening of the board, (d) said spring retainer finger being movable independently of the body of the shell and having a yieldable non-linear portion which engages the walls of said opening and shifts radially inward during insertion of the connector receptacle.

9. A connector receptacle as set forth in claim 8, wherein:

(a) said shell has an annular shoulder intermediate its ends, (b) said finger having a free tip portion, (c) the tip portion of said finger having an offset extending inwardly toward the body of said shell, and being adapted to nest against the said shoulder so as to reduce the likelihood of the finger being inadvertently caught and bent upwardly toward the open mouth of the shell during insertion of the connector receptacle into the opening of the printed circuit board.

10. A connector receptacle for insertion in an opening of a printed circuit board to receive the contact pin of a cooperable electrical component, comprising in combination:

(a) a tubular shell adapted to fit into said opening, said shell being completely closed at one end and having an open mouth portion at its other end in which the said contact pin can be inserted, (b) a separate and distinct spring contactor disposed in said shell, said contactor having a mouth and being adapted for engagement with said contact pin, (c) a pair of lugs integral with the shell, said lugs having bent over portions extending over the mouth of the contactor so as to hold the latter captive in the shell at all times, (d) a pair of external resilient spring retainer fingers integral with and connected to the shell at substantially opposite locations of its mouth portion, said fingers extending lengthwise of the shell and on opposite sides thereof and toward the closed end of the shell for a fractional portion of the length of the shell body and being adapted for engagement with the circuit board to maintain the shell in the opening thereof against inadvertent dislodgement prior to soldering of the connector receptacle into the opening of the board, (e) said spring retainer fingers being movable independently of the body of the shell and each having a yieldable non-linear portion which engages the walls of said opening and shifts radially inward and toward the other finger during insertion of the connector receptacle into the circuit board.

* * * * *